US007580535B2

(12) United States Patent
Baechler

(10) Patent No.: US 7,580,535 B2
(45) **Date of Patent: *Aug. 25, 2009**

(54) BINAURAL SYNCHRONIZATION

(75) Inventor: Herbert Baechler, Meilen (CH)

(73) Assignee: Phonak AG, Stafa (CH)

( * ) Notice: Subject to any disclaimer, the term of this patent is extended or adjusted under 35 U.S.C. 154(b) by 0 days.

This patent is subject to a terminal disclaimer.

(21) Appl. No.: 10/842,270

(22) Filed: May 10, 2004

(65) Prior Publication Data

US 2004/0208332 A1 Oct. 21, 2004

Related U.S. Application Data

(63) Continuation of application No. 09/431,702, filed on Nov. 1, 1999, now Pat. No. 6,768,802.

(30) Foreign Application Priority Data

Oct. 15, 1999 (WO) ..... PCT/CH99/00488

(51) Int. Cl.
*H04R 25/00* (2006.01)

(52) U.S. Cl. ..... 381/315; 381/312; 381/314

(58) Field of Classification Search ..... 381/23.1, 381/312, 314, 315, 317, 320, 321, 92, FOR. 128, 381/318, 91, 323
See application file for complete search history.

(56) References Cited

U.S. PATENT DOCUMENTS

| | | | | |
|---|---|---|---|---|
| 4,425,481 | A | 1/1984 | Mansgold et al. | |
| 5,434,924 | A | 7/1995 | Jampolsky | |
| 5,757,932 | A | 5/1998 | Lindemann et al. | |
| 6,148,087 | A | 11/2000 | Martin | |
| 6,549,633 | B1 * | 4/2003 | Westermann | 381/312 |
| 2004/0013280 | A1 | 1/2004 | Niederdrank | |
| 2004/0057591 | A1 | 3/2004 | Beck | |

FOREIGN PATENT DOCUMENTS

| | | |
|---|---|---|
| EP | 0 941 014 A2 | 9/1999 |
| WO | 98/16086 | 4/1998 |

OTHER PUBLICATIONS

WO/99/43185, Publication Date: Aug. 26, 1999, A Binaural Digital Hearing Aid System.

* cited by examiner

*Primary Examiner*—Huyen D Le
(74) *Attorney, Agent, or Firm*—Pearne & Gordon LLP

(57) ABSTRACT

Binaural hearing devices are operated by establishing a communication link between the devices. The communication link is exclusively for transmitting non-audio signals between two devices.

21 Claims, 2 Drawing Sheets

BINAURAL SYNCHRONIZATION

BACKGROUND OF THE INVENTION

This invention relates to a procedure for controlling hearing aid, a pair of hearing aids, as well as hearing aids.

In many cases, hearing impairment affects both ears so that both should be fitted with a hearing aid. So-called stereophonic or binaural hearing aids have been used in the past. More modern hearing-aid designs, typically equipped with at least two microphones, incorporate between these microphones and their output converter assembly, operating with an electromechanical converter, transmitter units in which the audio signal is processed and which can be operated in different, switchable transmission modes. For example, the audio-signal processing in one mode may be so tailored as to produce a relatively focussed audio-signal reception pattern while in the second mode a relatively nondirectional reception pattern is obtained, a third mode serves to squelch loud acoustic background noise, a fourth mode is particularly suitable for concert-hall use, etc. The switching from one transmission mode to another is done on the hearing aid itself, for instance by means of a toggle switch, with the user often being confused as to which of his two hearing aids is currently operating in which mode. One must consider that differentiating between the individual transmission modes in each of the two hearing aids is very difficult.

To solve this problem, a more recent approach in some cases has been to design remote control devices capable of controlling two hearing aids. To be sure, carrying and operating a remote control unit is not cherished by all users. A remote control, however, makes it possible to synchronize the transmission modes of both target hearing aids, for instance by only once pressing a single button that controls both hearing aids.

There also exist modem hearing aids which analyze the acoustic environment and on the basis of that analysis of the environment automatically make adjustments to obtain the optimal transmission mode. Where these devices are used binaurally, the mode adjustment for both hearing aids is often asynchronous since both units receive different audio patterns due for instance to head interference. Considering how quickly the acoustic environment and the head position can change, this may be irritating to the user.

SUMMARY OF THE INVENTION

This invention is aimed at introducing a procedure of the type first mentioned, as well as a hearing-aid set with appropriate individual hearing aids, by means of which the aforementioned problems including especially the need for a remote control are eliminated while permitting the easy, automatic control of the transmission mode selection for binaural hearing aids. This is accomplished by employing the above-mentioned procedure with the characteristic features of the claims. A set of hearing aids according to this invention is characterized by the features of the claims, with the individual hearing aids of the set corresponding to the claims.

By manually or automatically synchronizing the respectively enabled transmission modes of the hearing aids via a wireless connection between them—preferably a high-frequency connection—so as to be matched at a setpoint or selectable level, such synchronization can be obtained without a remote control unit for instance by pressing a button on one of the hearing aids or, along preset criteria described further below, by an automatic feature acting on both hearing aids, or by means of an added remote-control option.

In a first preferred implementation, the synchronization is established in a way that the two hearing aids, once synchronized, operate in the same active transmission modes. This can be accomplished by making one of the hearing aids the slave unit which adopts the respective mode of the other unit, the master. Which of the two hearing aids is the master can be predetermined, for instance the right-ear unit, but a situation-related changeover is possible for instance by selecting certain transmission modes as dominant modes which in the synchronization process determine the transmission mode of the other unit. For example, in automatic mode-enabling operation one of the hearing aids may be in a relatively infrequently used mode, such as the concert-hall setting, while the other unit may be operating in a standard mode. In that case, the synchronization will cause the hearing aid in the less frequently used transmission mode to connect to the hearing aid in the currently active standard mode and to adopt the latter.

It is also entirely possible in the case of hearing aids operating in different modes prior to synchronization to have such synchronization cause a switch to neither of these modes but to a third, common mode. This can be desirable when both hearing aids were in an infrequently used transmission mode, one for instance at the concert-hall level, the other at the loud-noise-squelching level. Upon synchronization, both hearing aids could thus be reactivated in the standard mode.

In another implementation of the procedure according to this invention, combinable in certain cases with the first procedure, synchronization causes each of the transmission modes to be switched to a different mode. This would be desirable in view of the ACTUAL presynchronization mode constellation which, empirically, is not made uniform but optimized. For example, if the presynchronization mode constellation involves two opposite modes, one being for instance at the concert-hall and the other at the loud-noise-squelching level, the synchronization could be so chosen as to adjust one unit for instance to the "slightly noisy environment" mode, the other to the standard mode, a post-synchronization constellation which, as experience has shown, will in most cases be a more satisfactory adjustment from the prior setting.

It is also entirely possible, in addition or as an alternative, to select the transmission modes enabled by synchronization based on an analysis of the currently prevailing or developing acoustic environment, in a way that for instance in the event of a strong change in the acoustic environment a synchronization process is triggered and the transmission modes are suitably adjusted. It is easy enough, for example in the case of a strongly increasing noise level which is registered primarily in one hearing aid, to enable an "increased attenuation" transmission mode in both hearing aids even though the second unit may not as yet have registered the augmented level due for instance to temporary head interference.

The synchronization itself can be triggered either manually on one of the hearing aids, or via remote control and/or through the result of an analysis of the current acoustic environment and/or through specific mode constellations which at least over an extended period have not been empirically determined as being optimized.

A set of hearing aids according to this invention and specified in the claims serves to solve the problem at which this invention is aimed. By virtue of the fact that there is a wireless communication link between the two hearing aids whereby merely a control signal for the selection unit is sent from one hearing aid to the other, it is possible to establish: a binaural balance between the hearing aids without the need to transmit complex audio processing signals between the hearing aids with a substantial attendant increase in energy consumption. For the synchronization as intended by this invention it suffices to transmit a few bits, identifying the desired transmission mode, with a long repetition rate from a few seconds to several minutes, which puts virtually no load on the power consumption. Moreover, it follows a short, mechanically most stable transfer path between the ears of the user, which also provides high immunity to RF interference.

BRIEF DESCRIPTION OF THE DRAWINGS

Preferred embodiments of the hearing-aid set according to this invention and the individual hearing aids preferably utilized therein are specified in the claim. The following describes this invention by way of examples with the aid of drawings in which:

DETAILED DESCRIPTION OF THE INVENTION

Figure 1:
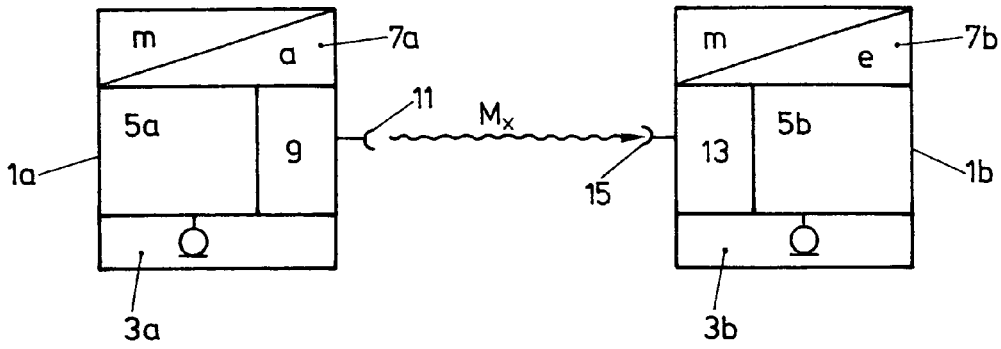
FIG. 1 schematically illustrates the principle of the procedure, the set of hearing aids and the corresponding individual hearing aids, each according to this invention.

By way of a schematic diagram of a set of two hearing aids according to this invention, FIG. 1 shows the underlying principle of the invention.

The two hearing aids 1*a* and 1*b* can be individually switched in situ, in different transmission modes relative to their transfer pattern between the input end of the microphone assembly 3*a*, 3*b*, to their electromechanical output converter systems 7*a*, 7*b* by way of the corresponding signal processing units 5*a*, 5*b*. At least one of the two hearing aids, 3*a*, is provided with a transmitter 9 and a transmitter antenna 11 for instance in the form of an inductance coil. At least the other hearing aid, 3*b*, is equipped with a receiver 13 and a receiver antenna again for instance in the form of an inductance coil. The transmitters/receivers 9 and 13, respectively, are preferably designed for high-frequency signal transmission, preferably within a frequency range from 100 kHz to 1 MHz. By way of the transmission/reception path 9/13 of the two hearing aids 1*a*, 1*b*, the transmission modes of the two hearing aids are mutually balanced, i.e. synchronized, by manual intervention and/or by automatic triggering, as will be described further below. In essence, this is accomplished by sending only transmission-mode identifiers, requiring just a few bits at low repetition rates. In the simplest case, illustrated in FIG. 1, the transmitting hearing aid 3*a* sends the identifier $M_x$, for its currently active transmission mode $M_x$, to the receiving hearing aid 3*b* which now changes its own transmission mode over to Mode $M_x$.

In this simple configuration per FIG. 1, one of the two hearing aids, 3*a*, thus serves as the master, the other, 3*b*, as the slave which adopts the transmission mode of the master hearing aid.

However, as explained further above, the mode synchronization in its enhanced form may also be implemented in such fashion that both hearing aids are synchronized to one identical transmission mode which differs from the mode active in either unit at the time of the synchronization.

It is also entirely possible at the time of synchronization to tune the hearing aids to different transmission modes, either one or none of which corresponds to the transmission mode active prior to the synchronization.

The modes enabled by the synchronization, especially in the case of automatic triggering of the synchronization, may reflect:

modes activated prior to the triggering and representing optimum empirical modes and/or the acoustic environment or any changes thereof, apart, in the simplest case, from uniformly matched modes.

The synchronization process proper may be triggered manually either on one of the two hearing aids or via a remote-control option for the hearing aids, or it can be triggered automatically, at preset time intervals and/or upon the incidence of empirically established unfavorable mode constellations in both hearing aids and/or of certain acoustic-environment conditions or changes thereof.

Notwithstanding the fact that this description will already open up to the expert a large number of possible forms of implementation of this invention, the following will serve to illustrate in schematic fashion additional implementation examples with the aid of signal-flow/function-block diagrams.

This is based on the premise that in most cases the hearing aids according to this invention are identical in design and that, whenever within the scope of the synchronization according to this invention the two hearing aids are to perform different functions, for instance along the master-and-slave concept mentioned, appropriate programming will control the activation and deactivation of these functions.

Figure 2:
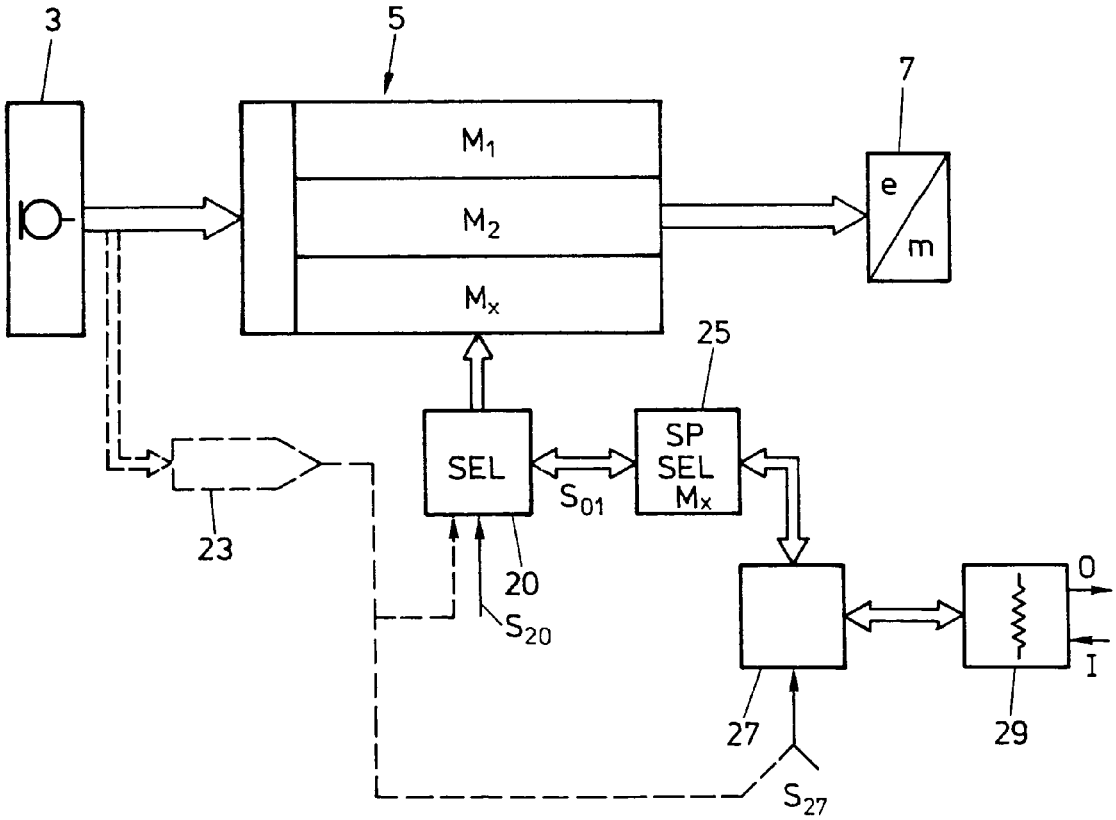
FIG. 2 schematically illustrates an individual hearing aid of a set of hearing aids according to this invention in the form of a simplified signal-flow/functional block diagram.

The function-block/signal-flow diagram in FIG. 2 represents two identical individual hearing aids of a hearing-aid set according to this invention. Function blocks shown in FIG. 1 bear the same reference numbers in FIG. 2. The microphone system 3 connects to the converter 7 via the signal processing unit 5. A selector switch 20 on the signal processing unit 5 permits the selection of at least two and preferably several transmission modes $M_1, M_2 \ldots M_x$.

The transmission mode M currently to be enabled is manually selected on the selector switch assembly 20, shown in position $S_{20}$, for instance by means of a toggle switch on the hearing aid or, wireless, via the remote control. In adaptation to the current acoustic environment, it is equally possible, as indicated by the dotted outline, to select the transmission mode M that is best for each prevailing acoustic-environment condition, by means of an evaluation unit 23 and the selector switch 20 on the hearing aid.

By way of example and as illustrated, the selector switch assembly 20 is provided with an identifier memory 25 in which the corresponding identifier $M_x$ of the currently active transmission mode M is stored. The identifier memory 25 connects to a transmission/reception controller 27 with a transmitter/receiver assembly 29. When a second hearing aid, preferably identical in design to the one in FIG. 2, is to be synchronized, and assuming that the hearing aid shown in FIG. 2 is the master, the transmission/reception controller 27 will be triggered as indicated by S27 and will send the mode identifier $M_x$, stored in the identifier memory 25, to the other hearing aid via the transmitter/receiver 29 which now acts as the transmitter -O-. The other hearing aid receives the identifier $M_x$, its transmission/reception controller 27 stores it in its own identifier memory 25, whereby, as indicated by the bidirectional path $S_{01}$, the selector switch assembly 20 is set according to the mode identifier received. The receiving hearing aid i.e. the slave, now operates in the same transmission mode $M_x$ as the transmitting hearing aid, that being the master.

By activating or deactivating the signal input $S_{27}$ which triggers this syhchronization process, one can specify which of the two hearing aids is to operate as the master and which as the slave.

As stated, the synchronization process in the master hearing aid can be triggered manually via $S_{27}$, or automatically. If, as indicated by the dotted outline in FIG. 2, the evaluation unit 23, upon an analysis of the current acoustic environment, automatically causes a mode change in the hearing aid concerned by way of the selector switch assembly 20, a synchronizing process can be automatically triggered via the control input $S_{27}$ either simultaneously or at a predetermined time interval. Of course, it is also possible (but not illustrated) to apply the synchronization trigger signal in the master hearing aid at the input $S_{27}$ by means of a timer operating at preset time intervals.

Once the master and slave functions have been established, this master/slave approach requires only one-way communication between the hearing aids.

Figure 3:
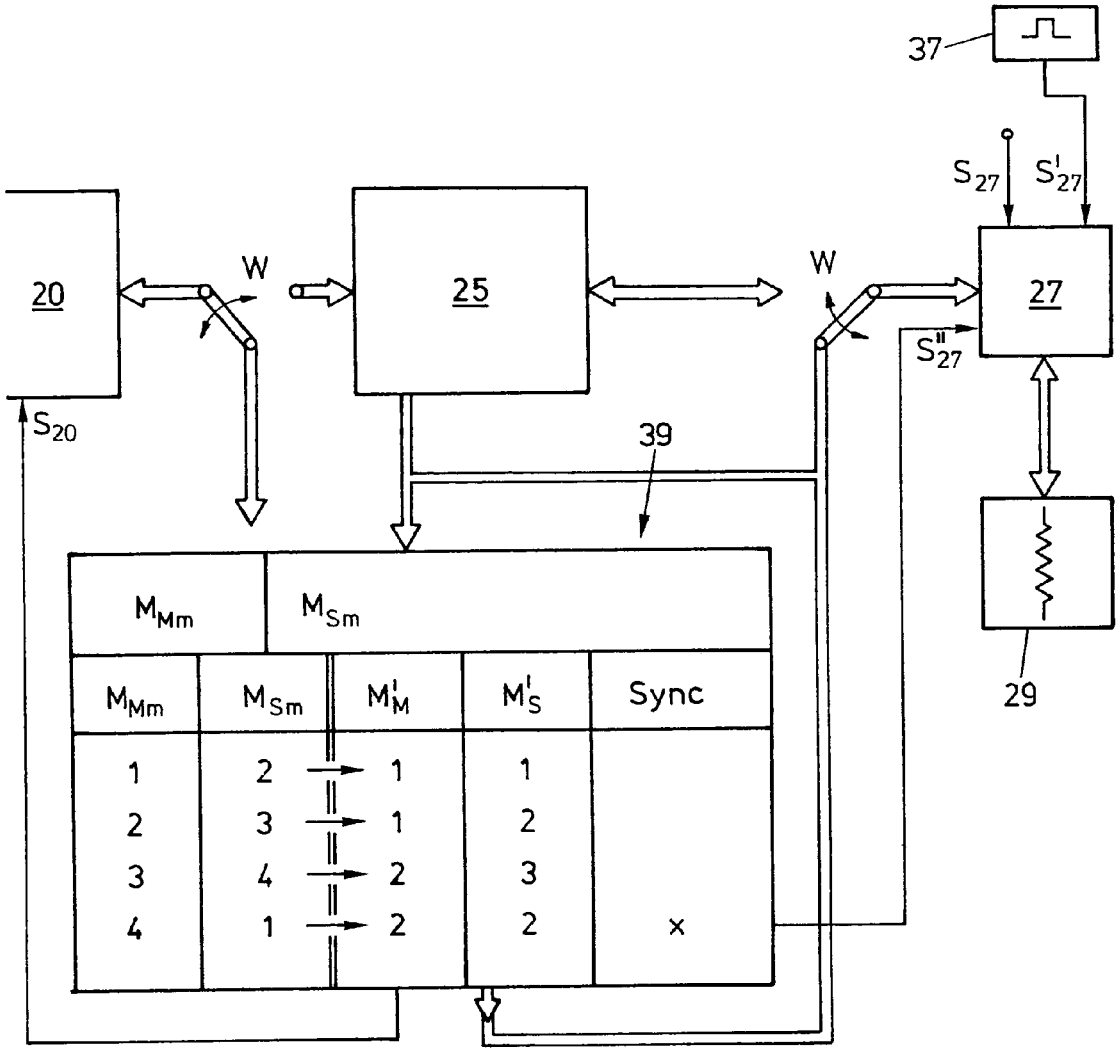
FIG. 3 is an illustration, analogous to FIG. 2, of an enhanced design version of a hearing aid according to this invention, as part of a two-piece set according to this invention and operating under utilization of the procedure according to this invention.

Building on the concept illustrated in FIG. 2 and essentially following the master/slave principle, FIG. 3 shows how at the point of synchronization the transmission mode of the master hearing aid need not be simply accepted but, instead, by employing for instance $M'_M$, $M'_S$ an optimal constellation is selected on the basis of the current constellation of both transmission modes $M_{Mm}$, and $M_{Sm}$.

FIG. 3 only shows the function blocks and signal paths which differ from those of the hearing aid in FIG. 2. Connected to the transmitter/receiver 27 is a timer 37 which, activated in only one hearing aid and operating at preset time intervals, sends the currently enabled transmission mode $M_{Sm}$ from the identifier memory 25 activated by this unit to the other unit. In contrast thereto, as schematically indicated by the switches W, a table memory 39 is activated in the other hearing aid, the master. The mode identifier $M_{Sm}$, sent by the slave in response to the transmission clock pulse of the timer 37, is stored in the table memory 39, as is the mode enabled by the currently valid identifier $M_{Mm}$, of the master. When, as described in reference to FIG. 2, the control signal $S_{27}$ triggers a synchronization, whether manually or automatically, a constellation $M'_M/M'_S$ which has been found to be optimal for the current constellation $M'_M/M'_S$ is retrieved from the table in the table memory 39, $M'_M$, and applied to the selector input $S_{20}$, and M's is sent to the master for storage in the identifier memory 25 and for activating the corresponding mode.

As indicated in FIG. 3, synchronization can also be triggered automatically by the presence of preselected mode constellations, in addition to or in lieu of the automatic triggering on the basis of an analysis of the acoustic environment as shown in FIG. 2, or to/of manual actuation. In FIG. 3, the constellation $M_{Mm}$,=4, $M_{Sm}$,=1 triggers a synchronization process at $S''_{27}$ the result being $M'_M$=2 and $M'_S$=2.

If both devices are configured identically, it is easy by virtue of the two constellations $M_{Mm}M_{Sm}$, to decide which hearing aid or which mode of the constellation is dominant, permitting instantaneous automatic assignment of the master/slave function. For example, mode 2 can be selected to dominate all others, 1, 3, 4, while 3 dominates modes 1 and 4. The device which is currently operating in the dominating mode will retain its mode or will adopt the master configuration described in reference to FIG. 3.

Moreover, the result of the acoustic environment analysis, obtained by means of unit 23 in FIG. 2, can be employed in addition to or perhaps in lieu of the instantaneous constellation $M_{Mm}/M_{Sm}$, for establishing the constellation $M'_M$, $M'_S$ to be created upon synchronization. As a consequence, the table in the table memory 39 will take on another dimension or the characteristic value of the acoustic-environment evaluation will appear in the table instead of the instantaneous constellation $M_{Mm}/M_{Sm}$.

The method according to this invention makes it possible, with minimal additional electric power consumption, to mutually optimize the binaurally used hearing aids for the mode-identifier transmission at relatively large time intervals. The user is able at any time to manually and especially by way of the remote control break through the established synchronization; based on the operating principle of this invention as described, the synchronization can be restored or reestablished, a process which in the case of automatic restoration can be disabled by the user.

What is claimed is:

1. A hearing device system comprising a first and a second hearing device and a communication link between said first and second devices, said communication link being operationally connected to at least one signal generating unit generating exclusively a signal to be transmitted via said communication link, said signal generating unit being a non-audio signal generating unit, wherein said first and said second devices comprise one of said signal generating units, and at least one of said devices being switchable in situ in at least two transmission modes between a microphone arrangement and an output converter, the other of said devices having said signal generating unit generating a control signal for switching between said at least two transmission modes at said one device.

2. The system of claim 1, wherein both of said first and second devices are switchable in situ in at least two respective transmission modes between a respective microphone arrangement and a respective output converter, said signal generating unit generating a transmission mode synchronizing signal for synchronizing the transmission modes at said devices.

3. The system of claim 1, said control signal generated by said signal generating unit switching one of said devices to the transmission mode of the other of said devices or switching both devices to transmission modes different from transmission modes established at said devices prior to generation of said control signal.

4. The system of claim 1, wherein said signal generating unit is controlled by a signal from an acoustical environment analyzing unit.

5. The system of claim 1, wherein said communication link is a wireless communication link.

6. The system of claim 1, wherein said communication link is not connected to transmit audio signals.

7. A method for operating binaural hearing devices, each of said devices being selectively operable in situ in at least two transmission modes between a microphone arrangement and an output converter comprising the steps of establishing a wireless communication link between the devices for transmitting control signals between the devices, wherein said control signals include signals for pairing the transmission modes of the devices, at least one of the devices analyzing an acoustic environment, and pairing the respective transmission modes of the devices by means of at least one of the control signals, as a function of a result of said analyzing, to an optimal mode constellation predetermined for the analyzed acoustic environment.

8. A method for operating binaural hearing devices, each of said devices being selectively operable in situ in at least two transmission modes between a microphone arrangement and an output converter comprising the steps of establishing a wireless communication link between the devices for transmitting control signals between the devices, wherein said control signals include signals for synchronizing the transmission modes of the devices, at least one of the devices analyzing an acoustic environment, and synchronizing the respective transmission modes of the devices by means of at least one of the control signals, as a function of a result of said analyzing, to an optimal mode constellation predetermined for the analyzed acoustic environment.

9. A method for operating binaural hearing devices, each of said devices being switchable in situ in at least two transmission modes between a microphone arrangement and an output converter comprising the steps of establishing a wireless communication link between the devices for transmitting control signals between the devices, wherein said control signals include signals for pairing the transmission modes of the devices, at least one of the devices analyzing an acoustic environment, and pairing the respective transmission modes of the devices by means of at least one of the control signals, as a function of a result of said analyzing, to an optimal mode constellation predetermined for the analyzed acoustic environment.

10. The method for operating binaural hearing devices, each of said devices being switchable in situ in at least two transmission modes between a microphone arrangement and an output converter comprising the steps of establishing a wireless communication link between the devices for transmitting control signals between the devices, wherein said control signals include signals for synchronizing the transmission modes of the devices, and synchronizing the respective transmission modes of the devices by means of the control signals, as a function of acoustic environment and predetermined optimal mode constellations.

11. The method of any one of claims 7-10, wherein said communication link is bidirectional.

12. The method of any one of claims 7-10, wherein one of said devices acts as a master, the second of said devices acts as a slave device with respect to said communication link.

13. A method according to any one of claims 7 and 9, wherein the step of pairing comprises balancing the transmission modes.

14. A method for operating binaural hearing devices at an individual, each of said devices being operable in at least two transmission modes between a microphone arrangement and an output converter respectively, comprising the steps of automatically analyzing an acoustical environment and controlling pairing of said transmission modes at said hearing devices in dependence of a result of said analyzing.

15. A binaural hearing device system comprising a first and a second hearing device and a communication link between said first and second devices, an assembly at each of said devices for controlling respectively each of said devices to operate in one of at least two signal transmission modes established between a microphone arrangement and an output converter respectively, said assemblies having a control input respectively, an acoustical environment analyzing unit with an output operationally connected to the control input of said assemblies so as to control mutual paring of said transmission modes at said hearing devices, wherein the communication link is connected to communicate information for mutual pairing of said transmission modes.

16. The system of claim 15 wherein the assemblies each comprise a selector switch for selecting the transmission mode.

17. The system of claim 15 wherein at least one of the control inputs is connected to be operated by the information communicated via said link.

18. The system of claim 15 wherein the information communicated via said link is dependent on the output of the acoustical environment analyzing unit.

19. The system of claim 15 wherein each hearing device further comprises a transmitter/receiver connected to transmit said information for mutual pairing.

20. The system of claim 15 wherein the information for mutual pairing includes a control signal transmission mode identifier.

21. The system of claim 20 wherein the assemblies each comprise a selector switch for selecting the transmission mode and each hearing device further comprises a transmitter/receiver connected to transmit said information for mutual pairing.

* * * * *